US005406820A

United States Patent [19]

Mosey

[11] Patent Number: 5,406,820

[45] Date of Patent: Apr. 18, 1995

[54] PIERCING MILL FOR SEAMLESS TUBE MANUFACTURE

[76] Inventor: George N. Mosey, 1912 Morrow Rd., Richmond, Ind. 47374

[21] Appl. No.: 103,407

[22] Filed: Aug. 6, 1993

Related U.S. Application Data

[63] Continuation of Ser. No. 855,071, Mar. 23, 1992, abandoned.

[51] Int. Cl.[6] ..... B21B 19/04

[52] U.S. Cl. ..... 72/97

[58] Field of Search ..... 72/95, 96, 97, 201, 72/209, 342.2

[56] References Cited

U.S. PATENT DOCUMENTS

| | | | |
|---|---|---|---|
| 693,381 | 2/1902 | Dicks | 72/97 |
| 1,996,500 | 4/1935 | Adams | 72/201 |
| 2,040,476 | 5/1936 | Geib, Jr. | 72/209 |
| 2,245,656 | 6/1941 | Engelbaugh et al. | 72/97 |
| 3,348,399 | 10/1967 | Prieur | 72/97 |
| 3,391,561 | 7/1968 | Calmes | 72/97 |
| 3,566,653 | 3/1971 | Unrath | 72/96 |
| 3,695,076 | 10/1972 | Kocks . | |
| 3,882,595 | 5/1975 | Reiley et al. . | |
| 4,052,874 | 10/1977 | Yoshiwara et al. . | |
| 4,212,178 | 7/1980 | Bretschseider . | |
| 4,318,294 | 3/1982 | Yoshiwara et al. . | |
| 4,409,810 | 10/1983 | Yamada . | |
| 4,470,282 | 9/1984 | Hayashi . | |
| 4,571,970 | 2/1986 | Moltner et al. . | |
| 4,577,481 | 3/1986 | Staat . | |
| 4,578,974 | 4/1986 | Pozsgay et al. . | |
| 4,760,724 | 8/1988 | Okazaki et al. | 72/97 |

FOREIGN PATENT DOCUMENTS

| | | | |
|---|---|---|---|
| 0219404 | 9/1986 | Japan | 72/97 |

*Primary Examiner*—Lowell A. Larson
*Attorney, Agent, or Firm*—Woodard, Emhardt, Naughton, Moriarty & McNett

[57] ABSTRACT

A tube making mill setup includes an induction heater for a billet, with means to transfer the heated billet directly to a piercing machine. The piercing machine includes main driving and gripping rolls on skewed axes and which drive the billet onto a piercing point. Upper and lower control rolls have axes parallel to the direction of billet drive through the machine. Internal cooling of the control rolls and the piercing point is provided by circulating cooling water through them. The piercing point is at the distal end of a mandrel which is swingable through an arc to place the formed tube on a take-away carriage.

14 Claims, 4 Drawing Sheets

PIERCING MILL FOR SEAMLESS TUBE MANUFACTURE

This application is a continuation of application Ser. No. 07/855,071, filed Mar. 23, 1992, now abandoned.

BACKGROUND OF THE INVENTION

1. Field of the Invention

This invention relates generally to the manufacture of seamless tubing, and more particularly to a small sized rolling and piercing mill.

2. Description of the Prior Art

There is a variety of prior art equipment for making seamless tubing and which includes rotary piercing in a machine which uses rolls to grip the stock and advance it through a piercing machine having a mandrel-mounted point ("plug") to pierce the center of the stock as the stock is driven through the machine. The equipment known to me is typically large and expensive, requires a lot of space, is harsh on the tooling involved, and is not readily adapted to comparatively low volume runs of particular sizes of tubing. Also there are machines shown in some prior art patents known to me as follows:

| U.S. Pat. No. | Inventor | Date Issued |
|---|---|---|
| 3,695,076 | Kocks | 10/03/72 |
| 3,882,595 | Reiley et al. | 5/13/75 |
| 4,052,874 | Yoshiwara et al. | 10/11/77 |
| 4,212,178 | Bretschseider | 7/15/80 |
| 4,318,294 | Yoshiwara et al. | 3/09,82 |
| 4,409,810 | Yamada | 10/18/83 |
| 4,470,282 | Hayashi | 9/11/84 |
| 4,571,970 | Möltner et al. | 2/25/86 |
| 4,577,481 | Staat | 3/25/86 |
| 4,578,974 | Pozsgay et al. | 4/01/86 |

It appears that most of these machines employ some processing, typically rolling, for various purposes following the piercing station. The additional steps require additional space in the processing plant. Also, some of the patents use "shoes" (shoes 12 and 12' and shoes 70 and 72' in the Hayashi patent, for example) to keep the workpiece properly positioned between the skewed driving rolls as those rolls advance the workpiece through the machine. In addition to the friction of the workpiece against the shoes, and the additional power required to drive the workpiece through the machine, the shoes tend to wear out and burn out, because the workpiece is at forging temperature during the piercing operation. Also, the piercing point is subjected to high loads, wear and temperature and must be taken off the arbor after each tube is pierced. The point must then be cooled externally. In addition, the pierced tube is removed from the mill with the arbor laying inside the tube. The arbor is then removed from the tube and cooled externally. Consequently, the piercing points must be replaced frequently. It is therefore an object of the present invention to overcome some of these problems associated with prior art equipment.

SUMMARY OF THE INVENTION

Described briefly, according to a typical embodiment of the present invention, a tube making mill setup includes an induction heater for a billet, with means to transfer the heated billet directly to a piercing machine. The piercing machine includes main driving and gripping rolls on skewed axes and which drive the billet onto a piercing point. Upper and lower control rolls are used, these rolls having axes parallel to the direction of stock drive through time machine. Internal cooling of the control rolls and the piercing point is provided by circulating cooling water through them. The piercing point is at the distal end of a mandrel which is swingable through an arc to place the formed tube on a take-away carriage. A guide collar on the mandrel receives the leading end of the tube as it is being formed and stabilizes it.

DESCRIPTION OF THE PREFERRED EMBODIMENT

Figure 1:
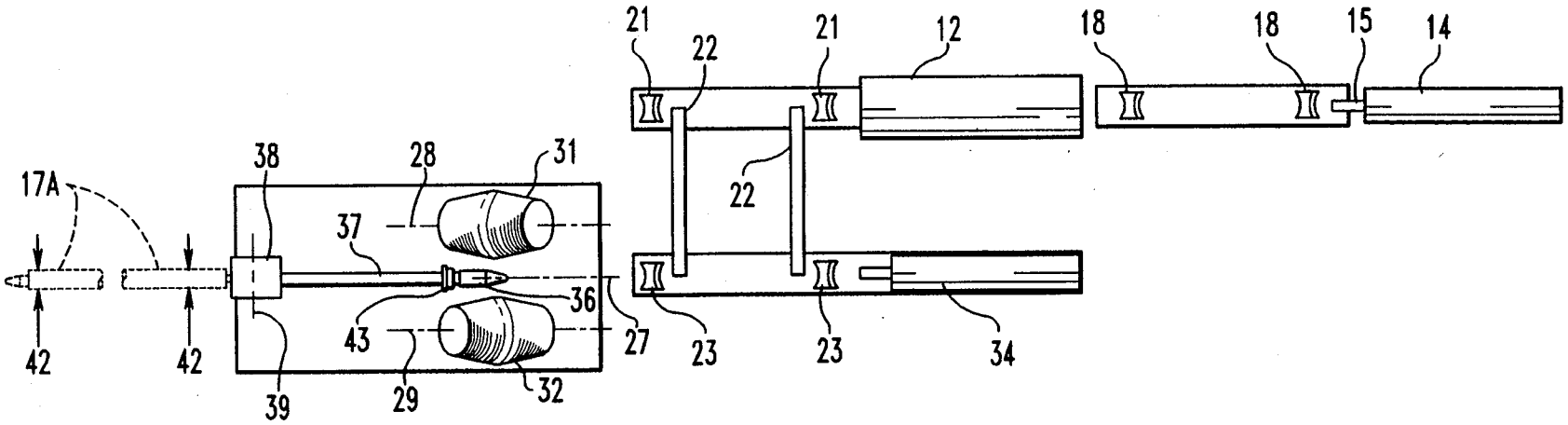
FIG. 1 is a diagramatic top plan view of the equipment layout according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
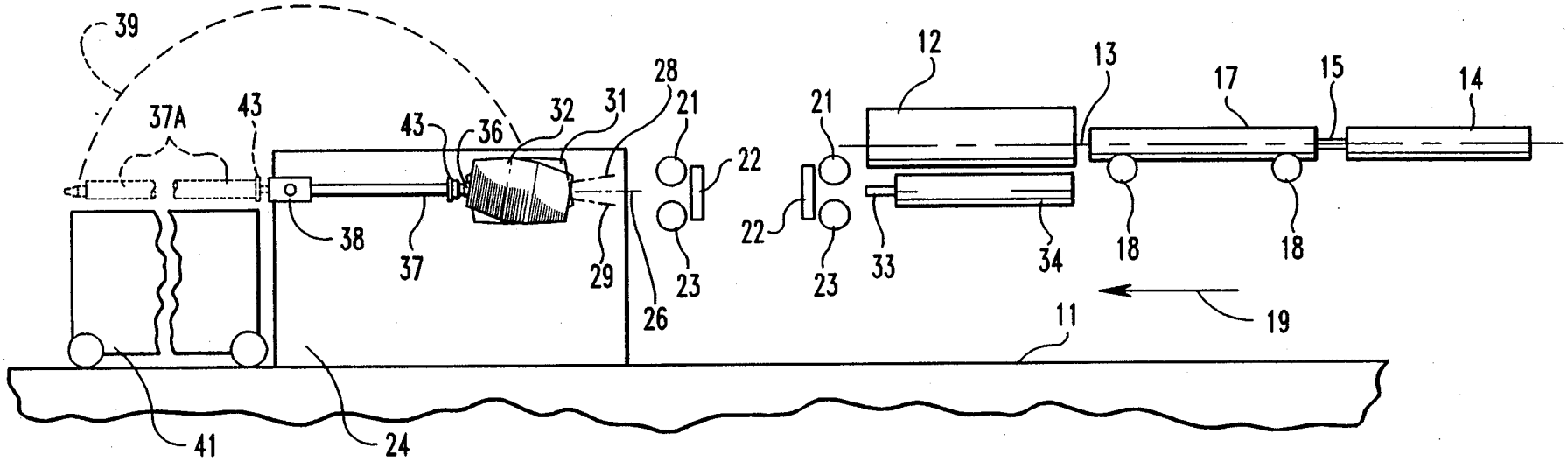
FIG. 2 is a diagramatic elevational view thereof.

Referring now to FIGS. 1 and 2, the equipment is typically located on the floor 11 of the plant. An electrical induction heater coil 12 is provided with its workpiece passageway center line 13 horizontal and in line with the center line of a pusher cylinder 14 having pointed rod 16 engaged in a center drilled end recess of billet 17 (not shown in FIG. 1) resting on rollers 18. The billet is pushed in the direction of arrow 19 by the extending piston rod of cylinder 14 to push the billet into the heater 12 where it remains for approximately four minutes and is heated to a forging temperature of approximately 2,250 degrees Fahrenheit. Then the pusher cylinder pushes the billet out of the heater onto rollers 21 at the exit end of the heater. The billet is transferred laterally from the exit rollers 21 by rolling down the support pipes 22 onto rollers 23 which align the billet with the processing path through the piercing machine 24. This path has a center line 26 lying in an upstanding plane 27 parallel to and halfway between upstanding planes containing the center lines 28 and 29 of drive rolls 31 and 32, respectively. The roll axes are skewed from horizontal in a manner well known in the art, with the center line of roll 32 being skewed upwardly and rearwardly from the entrance to the exit end of the roll, and the center line of roll 31 being skewed downwardly and rearwardly from the entrance to the exit end of the roll. Accordingly, as the billet is pushed in the direction of arrow 19 by the push rod 33 of the push cylinder 34, these rolls engage the billet and tightly grip it and drive it through the machine in the direction of arrow 19. As they do so, they crack the center of the billet, permitting advance of the billet around the piercing point or plug 36 on the end of mandrel 37. As the rolls 31 and 32 continue to drive the billet in the direction of arrow 19, the piercing plug forms the billet into a seamless tube 17T.

While one end of the mandrel has the piercing plug 36 on it, the other end of the mandrel is fixed in block 38 which is journaled in the machine 24 whereby it is pivotable about a horizontal axis 39 perpendicular to the plane 27. Therefore, although the mandrel is normally fixed in the position shown by the solid line in FIG. 2 during the piercing operation, it can be moved through a 180° arc indicated by the dotted line 39 to the dotted line position 37A of the mandrel. This is to enable placement of the formed tube oil a carriage 41 to which the tube can be clamped as indicated by arrows 42, following which the carriage can move the tube off the mandrel in the direction of arrow 19. Then the mandrel can be returned to the original position, and the block 38 locked in that position in preparation for piercing another billet.

Figure 4:
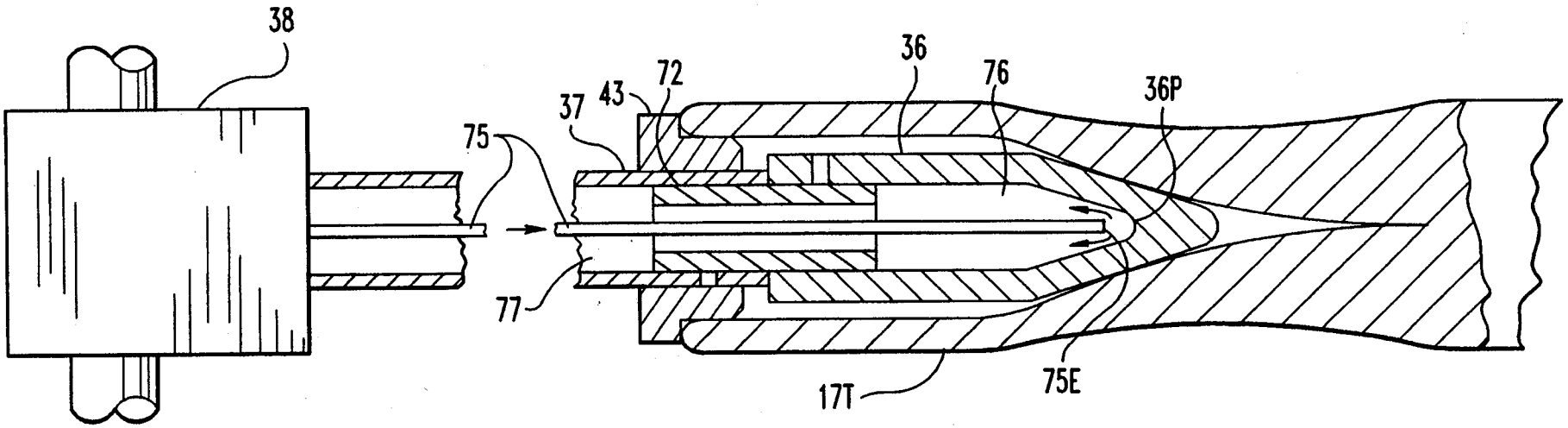
FIG. 4 is an enlarged fragmentary axial sectional view on a horizontal plane containing the piercing centerline.

A guide collar 43 is slidable along the mandrel and is manually pushed up against the rear end of the piercing point 36 prior to the piercing of the next billet. The chamfered front end of the collar receives and pilots the leading end of the tube thereon to the stop flange of the collar (FIG. 4). Then the collar slides back along the mandrel and rotates with the tube as the tube is driven axially and rotationally by the rolls 31 and 32. The collar 43 thus provides a sort of leading end bearing for the tube as it moves along the mandrel toward the mandrel mounting block 38.

Figure 3:
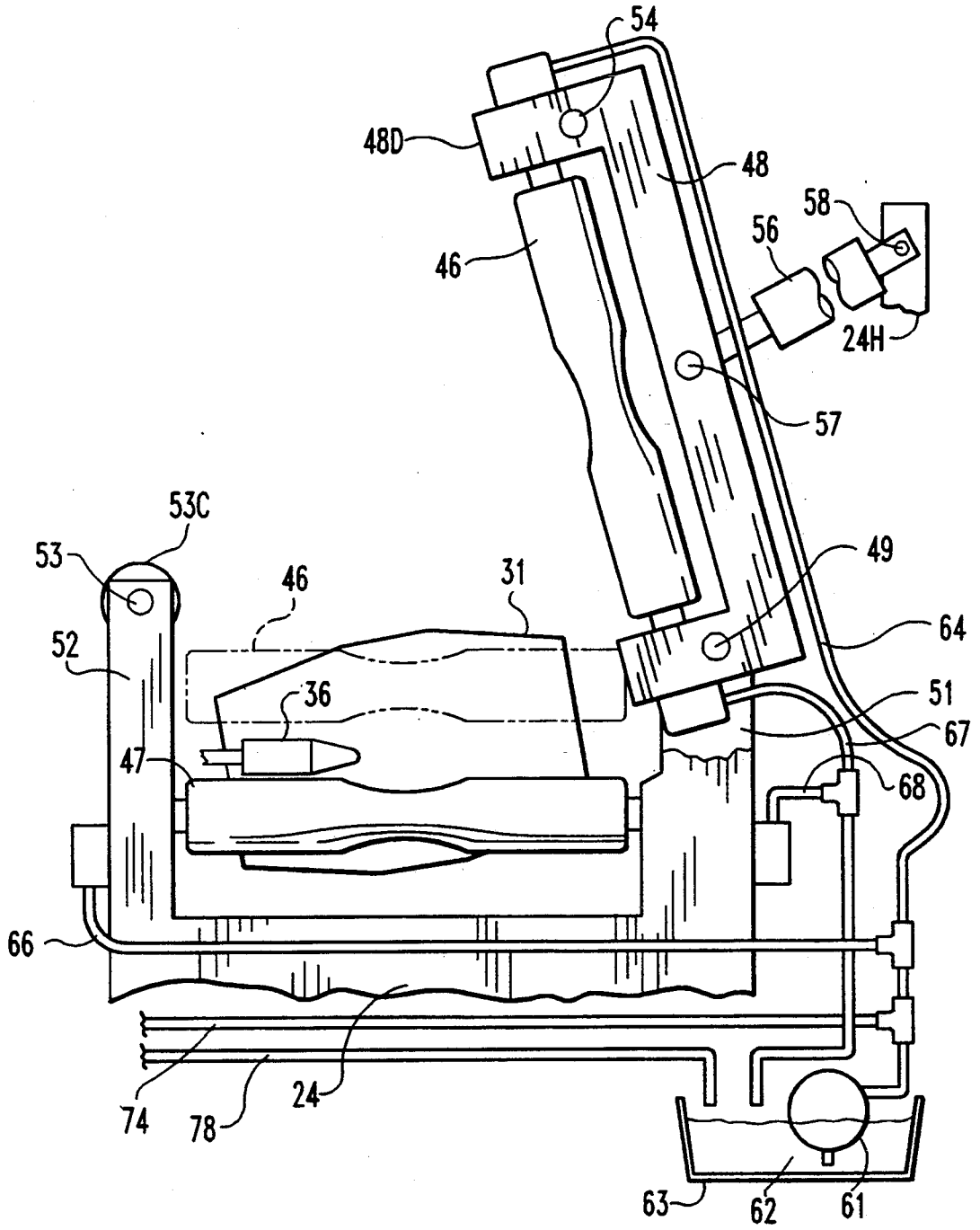
FIG. 3 is an enlarged fragmentary vertical sectional view of a portion of the piercing machine, the section plane containing the axis of the stock being processed through the machine.

According to one feature of the invention, there are two control rolls, a top roll 46 and bottom roll 47 which, when in the normal operating position indicated by the dotted line for roll 46 in FIG. 3, have axes of symmetry and rotation which are parallel to each other and to the axis 26, and lie in plane 27 equidistant from planes containing the main roll axes 28 and 29. The bottom roll 47 is rotatably mounted in the machine frame 24 while top roll 46 is rotatably mounted in a support frame 48 which is pivotally mounted on a shaft 49 spanning the space between the far post 51 and near post (not shown) of a yoke in the machine frame 24. The distal end 48D of the support frame 48 is normally received in an upwardly-opening yoke between the far post 52 and a near post (not shown) in the machine frame. Support frame 48 can be lowered from the position shown by the solid lines in FIG. 3 into position of the distal portion 48D between the yoke arm 52 and its counterpart and then locked by a transverse pin 53 passing through holes in the yoke arms and hole 54 in the frame 48 to lock the frame down, placing the roll 46 in position shown by the dotted lines. The raising and lowering of the roll 46 is done by operation of the air actuator 56 having the distal end of its piston rod pinned to the roll support frame 48 at 57 and the outer end of its air cylinder pinned at 58 to frame portion 24H. With the roll 46 down in its normal operating position as shown by the dotted lines, and as the billet is driven through the narrow gap between the rolls 31 and 32, and onto the piercing point 36, the rolls 46 and 47 which are rotated only in response to engagement of the rotating tube with them, can control the position of the billet entering and the tube exiting and thereby control the tube as it enters and passes over the piercing point 36.

The diameter of rolls 46 and 47 near the entrance ends is slightly smaller than the diameter of these rolls at the exit ends to accommodate the difference in outside diameter between the entering billet and the exiting tube. Also, the rolls 46 and 47 have a reduced diameter at the portion intermediate their ends and which is adjacent the drive rolls in order to accommodate the contour of the drive rolls, since the control rolls 46 and 47 must be close to the tube to provide the proper control and finish of the tube exiting the rolls.

According to another feature of the invention, the top and bottom rolls are water cooled. This is done by the use of a pump 61 taking water 62 from the sump 63 and pumping it through tubes 64 and 66 to the exit ends of the rolls from which the water passes through the rolls to the entrance ends and exits through tubes 67 and 68 and returns to sump 63.

Figure 5:
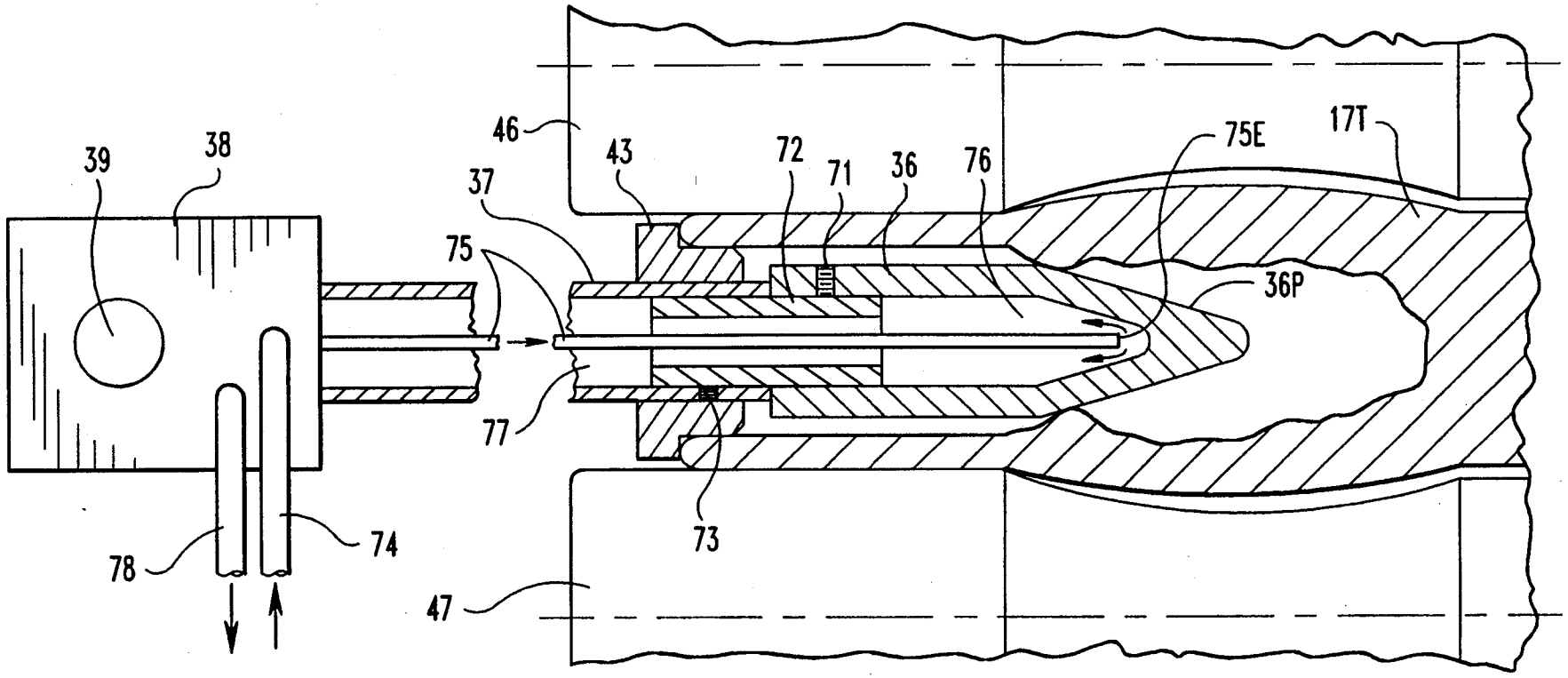
FIG. 5 is an enlarged fragmentary axial sectional view on a vertical plane containing the piercing centerline and showing the piercing point cooling system.

Another feature of the invention is shown in FIG. 5 which shows the piercing point 36 fastened by set screw 71 onto a nipple 72 which is tightly received in the mandrel 37 and fastened by set screw 73 to the mandrel. Water from pump 61 is supplied through tube 74 into the mandrel mounting block 38 from which it is discharged through a central supply tube 75 to the end 75E of the supply tube which is immediately behind the inner surface 36P at the sharp, distal end of the piercing point. Thus, the water supply through tube 74 and through the mandrel tube 75 into the point is effective to cool it and then return in the annular space 76 around the tube 75 in the point and space 77 around the tube 75 in the mandrel and then returns to sump from block 38 through the tube 78.

As examples, a number 4118 room temperature steel billet 36 inches long and 3.270 inches diameter is heated in the induction heater core 12 for four minutes, raising the billet temperature to 2250 degrees Fahrenheit and increasing its diameter to about 3.360 inches. Then the billet is promptly transferred to the piercing machine where it is driven at an axial rate of 3 feet per minute against and around the piercing point 36 while water is supplied from pump 61 to both the mandrel point 36 and through the rolls 46 and 47. The water supply temperature is approximately 70 degrees Fahrenheit. Meanwhile, water can be trickled onto the outside surfaces of the drive rolls 31 and 32 in a manner known in the art, so not shown herein. The two drive rolls are driven at 140 rpm. This operation results in the formation of a tube 72 inches long, 3.270 inches outside diameter and 2.350 inches inside diameter. When the six foot length of tube has been made, the upper roller frame 48 is unlocked by retraction of pin 53 by cylinder 53C and the top roll is raised by cylindrical air actuator 56. Then the mandrel may be raised by a rotary actuator, for example, pivoting block 38 through the 180° arc to deposit the tube onto the rack where it is clamped on carriage 41. Then the carriage is moved away in direction of arrow 19 to pull the tube off the mandrel. Then the mandrel is returned to original position, the guide collar 43 pushed forward thereon to the rear end of the point 36 to receive the next billet which typically has been undergoing the heating process during the piercing of the previous billet.

As examples of the spacing between the rolls for the 3.270 inch O.D. tube, the horizontal spacing between the nearest surfaces of the rolls 31 and 32 is 2.625 inches. The vertical spacing between the cylindrical surfaces of rolls 46 and 47 at their entrance end is 3.421 inches and the vertical spacing between the cylindrical surfaces of the rolls 46 and 47 at their exit ends (due to the difference in roll diameter) is 3.355 inches. The diameter of the piercing point is 2.100 inches.

The replacement of guide shoes with water cooled guide rolls not only reduces friction, but also controls and smoothes the outside of the tube making further rolling of the tube unnecessary. The tube is usable straight out of the piercer. The water cooling of the rolls prevents the rolls from overheating. It also saves the bearings on the ends of the rolls.

In addition, the guide collar 43 acts to stabilize the tube as it is being pierced and eliminates whipping action of the tube. Since the guide collar 43 holds the tube in the center of the rolls, the tube diameter is extremely round and controllable.

It has been found that the present invention can be practiced successfully with a pair of FAY brand lathes of 100 horsepower each and which have been modified to use the powered head stocks to mount and drive the rolls 31 and 32, one on each lathe. On these lathes, the cutting fluid cooling sumps are used for the cooling water. It is found that 100 horsepower is adequate to drive the roll mounted in the lathe, thus requiring 200 horsepower total for this function.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tube making mill comprising:

a base;

first and second tube drive rolls mounted on the base, the rolls being spaced for passage of bar stock between the rolls, the rolls being sized and having rotational axes oriented in different directions to enable the rolls to grip and drive the stock longitudinally forward in a first plane;

a piercing plug disposed in the space between the rolls and having a leading end;

third and fourth rolls, the plug being located between the third and fourth rolls, the third and fourth rolls being spaced to admit the bar stock between them as the bar stock passes between the first and second rolls and is driven in a forward direction by the first and second rolls against the leading end of the piercing plug to form a tube around the plug;

the third and fourth rolls having entrance ends and exit ends, and reduced diameters at portions intermediate their ends.

2. The mill of claim 1 and further comprising:

liquid cooling supply conduits from a cooling liquid source to the third and fourth rolls to convey a cooling liquid to the rolls;

return conduits from the third and fourth rolls to convey the cooling liquid back to the source without contacting the stock; and the spacing between the third and fourth rolls at the exit ends being less than at the entrance ends to establish the outside diameter of the tube formed from the stock which has passed through the first and second rolls to be smaller than the maximum stock diameter admissible at the entrance ends.

3. The mill of claim 2 and wherein:

the third roll is above the plug and the fourth roll below the plug; and the third and fourth rolls are coupled to the conduits for communication of fluid from the supply conduits through the interior of the third and fourth rolls to the return conduits to cool the interior of the rolls and thereby cool the exterior of the rolls.

4. The mill of claim 1 and wherein:

the diameters of the third and fourth rolls are greater adjacent their exit ends than the diameters of the third and fourth rolls adjacent their entrance ends.

5. The mill of claim 4 and wherein:

the reduced diameter portions are of diameters enabling expansion of the outer surface of the stock adjacent the piercing plug.

6. A tube making mill comprising:

a base;

first and second tube drive rolls mounted on the base, the rolls being spaced for passage of bar stock between the rolls, the rolls being sized and having rotational axes oriented in different directions to enable the rolls to grip and drive the stock longitudinally forward in a first plane;

a piercing plug disposed in the space between the rolls and having a leading end;

top and bottom rolls, the top roll being above the plug and the bottom roll being below the plug, the top and bottom rolls being spaced to admit the bar stock between them as the bar stock passes between the first and second rolls and is driven in a forward direction by the first and second rolls against the leading end of the piercing plug to form a tube around the plug;

the top roll being mounted to an arm that pivots upward about a horizontal axis to enable lifting the plug from the space between the first and second rolls.

7. The mill of claim 6 and further comprising:

a mandrel located in the first plane and located on a line which extends through the space between the first and second rolls, the mandrel having a proximal end mount which is pivotal on a horizontal axis, and the mandrel having a distal end remote from the proximal end mount, the plug being mounted at the distal end of the mandrel, whereby the plug can be swung upward out of the space between the rolls.

8. The mill of claim 7 and wherein:

the mandrel is arranged to pivot about the horizontal axis through an arc of about 180 degrees to place a tube formed thereon in position for removal axially from the mandrel by pulling the tube from the mandrel in the same forward direction as the stock is advanced through the rolls.

9. The mill of claim 8 and further comprising:

a carriage at the removal position for reception of a formed tube thereon, the carriage being drivable in the forward direction to remove a tube from the mandrel.

10. A tube making mill comprises:

a base;

first and second tube drive rolls mounted on the base, the rolls being spaced for passage of bar stock between the rolls, the rolls being sized and having rotational axes oriented in different directions to enable the rolls to grip and drive the stock longitudinally forward in a first plane;

a piercing plug disposed in the space between the rolls and having a leading end;

top and bottom rolls, the top roll being above the plug and the bottom roll being below the plug, the top and bottom rolls being spaced to admit the bar stock between them as the bar stock passes between the first and second rolls and is driven in a forward direction by the first and second rolls against the leading end of the piercing plug to form a tube around the plug;

the top and bottom rolls have entrance ends and exit ends, and the vertical spacing between the top and bottom rolls at the exit ends is such as to establish the outside diameter of the tube formed from the stock which has passed through the first and second rolls;

a mandrel having an end remote from the rolls and having an end between portions of the rolls, the plug being mounted to the end between portions of the rolls, and the plug having a hollow interior; and a cooling fluid supply means coupled to the plug;

the top and bottom rolls having reduced diameters at portions intermediate their ends to accommodate the contour of the drive rolls.

11. The mill of claim 10 and wherein the mandrel is a tube, the mill further comprising:

a fluid supply tube extending longitudinally along the inside of the mandrel and having an exit opening inside the plug adjacent the interior surface of the pointed leading end of the plug and supplying cooling fluid to the interior of the plug.

12. The mill of claim 11 and wherein:

the interior of the mandrel tube is in communication with a cooling fluid sump, and all of the cooling fluid supplied to the plug through the supply tube is returned through the interior of the mandrel tube to the sump.

13. A tube making mill comprising:

a base;

a piercing plug mounted on the base and having a piercing point;

a driver mounted on the base and operable to drive bar stock and the plug together in the direction of the longitudinal axis of the stock to pierce the stock along its axis and form a tube; and stock control guides adjacent the plug, with the plug disposed between the guides, the guides being arranged to accommodate radial expansion of the stock at a location engaging the tube at the front of the piercing point, the guides having portions engaging the tube behind the location of maximum radial dimension of the piercing plug and spaced from each other to establish a finished outside diameter dimension of the tube.

14. The mill of claim 13 and wherein:

the guides are rolls and include portions closer together behind the piercing point than in front of the piercing point, to establish a finished outside diameter dimension of the tube.

* * * * *